US012083584B2

(12) United States Patent
Vivas et al.

(10) Patent No.: US 12,083,584 B2
(45) Date of Patent: Sep. 10, 2024

(54) HALLOYSITE CLAY AS SMOKE-REDUCING ADDITIVE FOR POLYURETHANE-FORMING BINDER SYSTEM

(71) Applicant: ASK Chemicals LLC, Wilmington, DE (US)

(72) Inventors: Paula Vivas, Dublin, OH (US); Matthew Shoffner, Dublin, OH (US); Lee Horvath, Powell, OH (US)

(73) Assignee: ASK Chemicals LLC, Wilmington, DE (US)

( * ) Notice: Subject to any disclaimer, the term of this patent is extended or adjusted under 35 U.S.C. 154(b) by 273 days.

(21) Appl. No.: 17/786,208

(22) PCT Filed: Jan. 11, 2022

(86) PCT No.: PCT/US2022/011987
§ 371 (c)(1),
(2) Date: Jun. 16, 2022

(87) PCT Pub. No.: WO2022/155137
PCT Pub. Date: Jul. 21, 2022

(65) Prior Publication Data

US 2023/0249244 A1 Aug. 10, 2023

Related U.S. Application Data

(60) Provisional application No. 63/136,431, filed on Jan. 12, 2021.

(51) Int. Cl.
*B22C 1/02* (2006.01)
*B22C 1/22* (2006.01)

(52) U.S. Cl.
CPC ..... *B22C 1/02* (2013.01); *B22C 1/2273* (2013.01)

(58) Field of Classification Search
CPC .... B22C 9/02; B22C 9/10; B22C 1/02; B22C 1/2273
See application file for complete search history.

(56) References Cited

U.S. PATENT DOCUMENTS

| | | | |
|---|---|---|---|
| 3,485,797 | A | 12/1969 | Robins |
| 3,676,392 | A | 7/1972 | Robins |
| 5,616,631 | A | 4/1997 | Kiuchi et al. |
| 6,391,942 | B1 | 5/2002 | Chang et al. |
| 6,479,567 | B1 | 11/2002 | Chang |
| 6,509,392 | B1 | 1/2003 | Jhaveri et al. |
| 6,559,203 | B2 | 5/2003 | Hutchings et al. |
| 6,602,931 | B2 | 8/2003 | Chen et al. |
| 7,125,914 | B2 | 10/2006 | Chang |
| 7,984,750 | B2 | 7/2011 | Pederson et al. |
| 10,829,691 | B2 | 11/2020 | Gonzalez-Garcia et al. |
| 2003/0101907 | A1* | 6/2003 | Brown ..... B22C 1/02 106/38.3 |

FOREIGN PATENT DOCUMENTS

WO 2016/038156 A1 3/2016

* cited by examiner

*Primary Examiner* — Kevin E Yoon
(74) *Attorney, Agent, or Firm* — Standley Law Group LLP; Jeffrey S. Standley; Kenny W. Pung

(57) ABSTRACT

An amount of a halloysite clay, used as an additive in a foundry mix composition having a polyurethane-based binder system, reduces the amount of smoke emitted when molds and cores formed from the composition are exposed to molten metal, as compared to when the halloysite clay is not used.

20 Claims, 1 Drawing Sheet

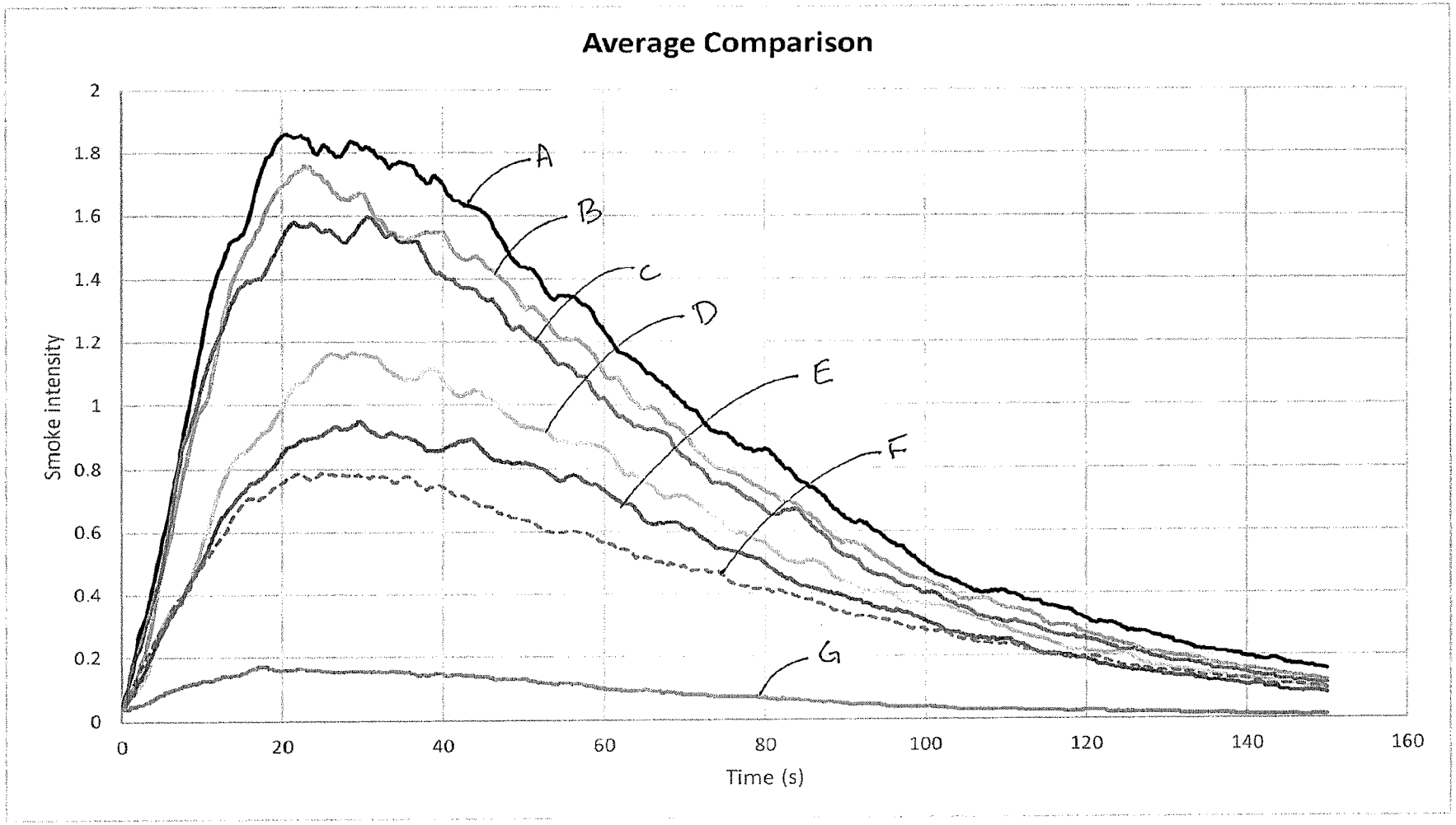
Average Comparison
Smoke Intensity
Time (s)
0
0.2
0.4
0.6
0.8
1
1.2
1.4
1.6
1.8
2
0
20
40
60
80
100
120
140
160
A
B
C
D
E
F
G

HALLOYSITE CLAY AS SMOKE-REDUCING ADDITIVE FOR POLYURETHANE-FORMING BINDER SYSTEM

CROSS-REFERENCE TO RELATED APPLICATIONS

This application is a non-provisional of U.S. provisional patent application 63/136,431, filed on 12 Jan. 2021, which is incorporated by reference as if fully recited herein.

TECHNICAL FIELD

This disclosure relates to an additive for a binder system used for casting metal parts, using molds and cores formed using a polyurethane-forming binder system. More particularly, it relates to a foundry mix containing an appropriate foundry aggregate, especially sand, and two polyurethane binder precursors. A liquid catalyst is used to cure the polyurethane formed from mixing the binder precursors. By including an effective amount of halloysite clay as an additive to the foundry aggregate, the smoke generated from decomposition of the organic compounds in the binders is unexpectedly suppressed.

BACKGROUND

Molds and cores used in the casting of metal parts can be made from a foundry aggregate and/or a foundry sand, held together by a foundry binder. Several processes are used for this.

In a "no-bake" process, a foundry mix is prepared by mixing an appropriate aggregate with the binder and a curing catalyst. After compacting the foundry mix into a pattern, the curing of the foundry mix provides a foundry shape useful as a mold or core.

In a "cold box" process, a foundry mix is prepared by mixing an appropriate aggregate with a binder. After forcing the foundry mix into a pattern, a catalyst vapor is passed through the foundry mix, causing it to cure and provide a foundry shape useful as a mold or core.

In yet a further process, the foundry mix is prepared by mixing the aggregate with a heat reactive binder and catalyst. The foundry mix is shaped by compacting it into a heated pattern that causes the foundry mix to cure, providing a foundry shape useful as a mold or core.

Focusing on the "no-bake" processes, then, some widely used binders in the foundry industry include phenolic urethane no-bake binders, ester-cured phenolic no-bake binders and furfuryl alcohol acid curing no-bake binders.

The assignee of the present invention has been significantly involved in providing foundry binders for over forty years. Some representative US patents and published applications include U.S. Pat. Nos. 3,485,797 and 3,676,392 to Robins, U.S. Pat. Nos. 6,391,942, 6,479,567 and 7,125,914 to Chang, U.S. Pat. No. 6,559,203 to Hutchings, U.S. Pat. No. 6,602,931 to Chen and US published application US 2005/0009950 to Dando.

Several variables have been considered when formulating binder packages. For example, U.S. Pat. No. 5,616,631, to Kiuchi, teaches that prior no-bake binders have tended to have low curing rates and low initial strength. A long time is needed for the binder to set up sufficiently to allow the cured mold to be removed from the pattern, which results in poor utilization of the pattern. In the terminology of the present specification, the "strip time" is the time that elapses from when the binder components are mixed with the sand or aggregate until the foundry shape formed reaches a level of 90 on the Green Hardness "B" scale, using the gauge sold by Harry W. Dietert Co, of Detroit, MI, as is taught by the commonly-owned U.S. Pat. No. 6,602,931. Kiuchi '631 teaches that it is a desired result to increase the initial tensile strength, so as to keep the strip time short.

Another term used in the prior art and in this specification is "work time." In this specification, the rigorous definition of work time is the time between when the binder components and the aggregate and sand are mixed and when the foundry shape formed therefrom attains a level of 60 on the Green Hardness "B" scale, again using the gauge from Dietert. In terms more applicable to the foundry, the "work time" defines the approximate time during which the sand mix can be effectively worked in forming the mold and core. The difference between strip time and work time is, therefore, an amount of dead time during which the mold being formed cannot be worked upon but cannot yet be removed from the pattern. The ratio of work time to strip time ("W/S") expresses this concept in a dimensionless manner, and ranges (at least in theory) from 0 to 1.

Ultimately, an objective of any foundry binder system is to use the heat from the poured molten metal to decompose the binder compounds once a solid skin has been formed on the metal in the mold that reproduces the shape of the mold core. In this manner, the sand and/or other aggregate can be readily recovered and reused. As taught by U.S. Pat. No. 7,984,750, to Pederson, this need to decompose the binder is challenged when the mold is used with a metal poured at a temperature that is lower than the approximately 1000° C., which is the temperature at which cast iron is poured. Aluminum and magnesium are examples of metals that are poured at less than 1000° C.

Almost as important as the ability to decompose the binder is to provide a binder that is environmentally acceptable. Because of the exposure of workers to the foundry mix both before casting and after, issues such as smoke, toxicity and odor must be considered, although the materials involved effectively limit the discussion to reducing, rather than eliminating, the exposure.

Clearly, the ability of a binder system to provide a specified foundry mix with proper tensile strength and working time are pre-eminent. Any additive that acts to suppress smoke and odor must not result in a sacrifice of casting quality, although some compromises may need to be made to assure compliance with environmental health and safety.

It is therefore an object to provide an improved binder system, especially for a "no-bake" organic binder system, which meets job qualifications while suppressing at least smoke production.

SUMMARY

This and other objects are met by a foundry mix composition, comprising: a polyurethane binder precursor, provided in two parts, the first part comprising a polyol component and the second part comprising a polyisocyanate component; a liquid curing catalyst; an appropriate foundry aggregate; and a halloysite clay.

In some of the embodiments, the halloysite clay is present in the range of from about 1 to about 4 wt %, based on the weight of the foundry aggregate.

In many embodiments, the liquid curing catalyst is a liquid amine catalyst, preferably containing 4-(3-phenylpropyl) pyridine with solvent naphtha, especially where the liquid curing catalyst is present at about 4 wt %, based on the first part of the polyurethane binder component.

In the embodiments, the polyol component comprises a phenolic resole resin with dibasic esters and solvent naphtha.

In some of the embodiments, the isocyanate component comprises an isocyanate with rapeseed methyl ester and solvent naphtha.

In some of the embodiments, a weight ratio of the first part of the polyurethane binder precursor to the second part of the polyurethane binder precursor is about 60/40, exclusive of the liquid curing catalyst.

In some embodiments, the polyurethane binder precursor is about 1.2% by weight, based on the weight of the foundry aggregate.

Other objects are met by method for preparing a foundry mix, comprising the steps of:

- adding a halloysite clay to an appropriate foundry aggregate and mixing, wherein the halloysite clay is present in an amount in the range of about 1 to about 4 wt %, based on the weight of the foundry aggregate;
- adding, to the mixed halloysite clay and foundry aggregate, a first part of a polyurethane binder precursor and a liquid curing catalyst and mixing, the first part of the polyurethane binder precursor comprising a polyol component; and
- adding a second part of the polyurethane binder precursor, the second part of the polyurethane binder precursor comprising an isocyanate.

In some of these methods, a weight ratio of the first part of the polyurethane binder precursor to the second part of the polyurethane binder precursor is about 3 to 2, exclusive of the liquid curing catalyst.

Further, in some of the methods, the polyurethane binder precursor is about 1.2% by weight, based on the weight of the foundry aggregate.

Additional objects are obtained by a foundry mold or core, formed from the foundry mix.

Other objects are obtained by a no bake process for preparing a foundry shape, comprising the steps of:

- providing an appropriate amount of the foundry mix composition;
- mixing intimately the halloysite clay with the appropriate foundry aggregate;
- preparing a foundry molding compound by separately mixing the polyurethane bonder precursor and the liquid curing catalyst with the mixed halloysite clay and foundry aggregate;
- inserting the foundry molding compound into a pattern, allowing the mixture to cure into a foundry shape, and
- removing the foundry shape from the pattern.

BRIEF DESCRIPTION OF THE DRAWING

The single FIGURE presented is a plot of smoke intensity versus time for seven foundry mixes.

DETAILED DESCRIPTION

Smoke Reduction

The inventive concept is clearly presented by reference to the appended FIGURE, which shows the intensity of smoke originating from the use of an organic binder system in metal casting, as plotted as a function of time. In the FIGURE, the same binder system was used, but the foundry mix and particularly the additives to the foundry mix were varied. The data presented shows smoke intensity for a period of 150 seconds, using the smoke-intensity test described in more detail below. Measurements of intensity of smoke were acquired every 200 milliseconds. It is readily observed that most of the plotted examples had substantially converged after the first 150 seconds. One of the examples is strikingly distinctive, both as to the instantaneous smoke intensity, as well as to the overall area under the plot. That area represents, at least qualitatively, the total smoke generated during the test. In each case, the plot is an average obtained from three experimental runs.

Starting from the top and working downward, the first of the seven plots, labeled as A, represents a base case of binder system and foundry aggregate, with no additive. Summing the area under the curve, based on the intensity of the no-additive sample, this curve has an overall smoke generation of 14.6.

The second plot, labeled as B, represent data from the same binder system and foundry aggregate with 4% VU 450 added to the foundry aggregate. The designation VU 450 represents one of the VEINO ULTRA series of commercially available sand additives from ASK Chemicals, specifically VEINO ULTRA 450. It contains ferrous oxide and red and black iron a blend of ferrous oxides. It is a sand additive used to reduce the amount of veining that occurs in metal casting. The sum of the area under the curve has an overall smoke generation of 13.0.

The third plot, labeled as C, represents data from the same binder system and foundry aggregate with 4% SphereOX® added to the foundry aggregate. SphereOX is commercially available from Chesapeake Specialty Products, which claims in its literature that a unique manufacturing method results in an extremely pure iron oxide, in predominantly spherical shape with unique physical and chemical characteristics. The sum of the area under the curve has an overall smoke generation of 12.3.

The fourth plot, labeled as D, represents data from the same binder system and foundry aggregate with 4% of an additive comprising yellow iron oxide ("YIO"), designated as VU 450/YIO, in which the YIO content is 20% the sum of area under the curve has an overall smoke generation of 9.3.

The fifth plot, labeled as E, represents data from the same binder system and foundry aggregate with 4% of an additive comprising 60% yellow iron oxide and, in aggregate, 40% of red iron oxide, black iron oxide and clay. The additive is designated as VU NB LOSMK. The sum of area under the curve has an overall smoke generation of 7.9.

The sixth plot, labeled as F, represents data from the same binder system and foundry aggregate with 2% halloysite clay. Halloysite is an aluminosilicate clay mineral with the empirical formula $Al_2Si_2O_5(OH)_4 \cdot n\ H_2O$, CAS Number 1332-58-7. It occurs intermixed with dickite, kaolinite, montmorillonite and other clay minerals. According to U.S. Pat. No. 10,829,691, Halloysites are chemically similar to kaolin clays consisting of a two-layered (1:1) aluminosilicate. The only difference between Kaolin clay and Halloysite is the morphology of crystals. The Halloysite structure consist of hollow nanotubes rather than only stacked plate-like structures as observed in kaolin. The halloysite clay used in this testing is commercially available from Applied Minerals, Inc. under the DRAGONITE™ trade name. The sum of area under the curve has an overall smoke generation of 6.8.

The seventh plot, labeled as G, represents data from the same binder system and foundry aggregate with the same clay additive, but at 4% addition instead of 2%. The sum of area under the curve has an overall smoke generation of 1.3.

From the plotted data, it is quite clear that the systems group themselves into three groups of similar results. The third group, consisting solely of the 4% halloysite composition, stands distinctly away from the other additive sample described here. Sample G showed 90% reduction in smoke when it is compared to sample A (no additive).

Binder System and Foundry Aggregate

PEP SET MAGNA 1215/2215 is a commercially available polyurethane-forming binder system. The binder system is sold in two separately packaged components. The first part, designated 1215 and commonly referred to as Part I, contains phenolic resole resin, dibasic esters and solvent naphtha, along with performance additives. The second part, designated 2215 and commonly referred to as Part II, provides an isocyanate component, rapeseed methyl ester and solvent naphtha, along with performance additives. Parts I and II are mixed and a liquid amine catalyst is added. PEP SET 3501 CATALYST contains 4-(3-phenylpropyl) pyridine (CAS Number 2057-49-0) and solvent naphtha.

In the experimental protocol, test cores were prepared. The Part I and the catalyst, in this case, a commercially available PEP SET 3501 CATALYST were mixed with, as a foundry aggregate, a round silica sand sold commercially as WEDRON 410 sand. Then, the Part II was added. The weight ratio of the Part I to the Part II was 60/40, exclusive of the catalyst, and the binder level was 1.2% by weight, based on sand ("BOS"). The catalyst was added at 4% by weight based on Part I. In one case, designated as A in the FIGURE, no additive was added to the foundry aggregate, to establish a baseline. In the cases designated as B through G in the FIGURE, an amount of a specified additive was added to the foundry aggregate prior to being mixed with the Part I component.

Smoke Reduction Test Protocol

The smoke reduction data depicted in the FIGURE were obtained from polyurethane no-bake cores made with the PEP SET MAGNA 1215/2215 binder system as described above. All additives were run at 4.0% BOS, unless otherwise indicated. The cores were allowed to rest for 24 hours before measurements were taken. The cores were then cut into pieces of similar mass and heated for 1 minute at 700° C. immediately prior to measuring. Once removed from the oven, the cores were placed on an instrument stage and raised into a chamber. In the instrument, the emitted smoke passes through a vertical tube having an array of lights on a first side thereof and photocells on the opposite side. The reduction in light transmission through the tube is considered as the rate of "smoke emission", although the direct measurement is opacity. The instrument measures the intensity of smoke every 200 miliseconds and data is acquired using a data logger. Data is collected until the signal intensity is no longer detected, which is typically ~150 seconds. The stage was then cleaned with air, and each sample was tested in duplicate.

In each experiment the mass was kept constant at 46±0.1 grams. Any variation associated with core mass was accounted for by taking the average mass. To determine the total intensity—of the smoke—for each mix the experiment was run in triplicates. In each test the sum of the area under curve was estimated. All samples were normalized based in the "no additive" sample.

Tensile Strength Protocol

Based on the most relevant results for the smoke data, four compositions samples or mixes were selected for tensile strength and work time/strip time testing. This was consistent with the understanding that commercial acceptance relies upon the ability to reproducibly provide quality castings. Once mixed, the resulting foundry mix was compacted into a tensile specimen in the shape of a dog-bone, using a shaped core pattern. The resulting test specimens ("dog-bones") were tested for tensile strength at one hour, three hours and 24 hours, this last example being conducted at the same humidity level as the 1 and 3 hour tests. There was also a 24 hour test at a high relative humidity (90% RH), after removal from the core pattern. In each case, three specimens were tested, so that an average tensile strength and a standard deviation could be obtained for each mix.

Before conducting the tensile strength tests, the selected compositions were tested to adjust them as needed to provide a commercially acceptable work time and strip time. These terms are described in detail above, with reference to U.S. Pat. No. 5,616,631, to Kiuchi. Further detail is found in commonly-owned U.S. Pat. No. 6,602,931 to Chen. Knowing that "no-bake" binders have tended to have low curing rates and low initial strength it was desirable to understand the effects of any smoke-reducing additive on these properties.

The difference between strip time and work time is an amount of dead time during which the mold being formed cannot be worked upon but cannot yet be removed from the pattern. The ratio of work time to strip time ("W/S") expresses this concept in a dimensionless manner, and ranges (at least in theory) from 0 to 1. A long work time and a high ratio of W/S are desirable.

It was determined upon initial observation that a goal for 5 minutes for work time and strip time was desirable and that this would be achieved by adjusting the amount of catalyst used so that each composition would meet this goal.

The baseline composition identified in the FIGURE as composition A contained PEP SET MAGNA 1215 and 2215 in a 60/40 ratio at 1.2% by weight (BOS). The aggregate was round grain WEDRON 410 sand. To bracket the work time and strip time requirement of 5 minutes, two levels of PEP SET 3501 CATALYST were used. At 2% by weight based on Part I, the work time was 6 minutes and the strip time was 6:45 minutes. By adjusting the catalyst to 3% by weight based on Part I, the work time was lowered to 4:15 minutes and the strip time to 5 minutes. In the data below, these compositions, with no additive, are identified as A2 and A3.

Composition B was also selected for tensile testing. Here, PEP SET aMAGNA 1215 and 2215 were used in 60/40 ratio at 1.2% with WEDRON 410 sand. The additive was designated as VU 450 at 4% by weight BOS. PEP SET 3501 CATALYST at 4% by weight based on Part I provided a work time of 4:15 minutes and a strip time of 4:45 minutes.

Composition F was selected because of the 2% by weight BOS of halloysite additive used. As in the other compositions to be tested for tensile strength, PEP SET MAGNA 1215 and 2215 were used in the 60/40 ratio at 1.2% with WEDRON 410 sand. At 6% by weight based on Part I, PEP SET 3501 CATALYST provided a foundry mix with a work time of 4 minutes and a strip time of 4:45 minutes.

Composition G was selected because of the 4% by weight BOS halloysite additive level, which provided the unexpectedly low smoke emission. As above, PEP SET MAGNA 1215 and 2215 were used in the 60/40 ratio at 1.2% with WEDRON 410 sand. However, a level of 5% by weight based on Part I of PEP SET 3551 CATALYST was used to achieve a foundry mix with a work time of 4:15 and a strip time of 5:45. PEP SET 3551 CATALYST contains 4-(3-phenylpropyl)pyridine at a higher level than PEP SET 3501 CATALYST which was used in Composition F.

The test provides the following data for tensile strength (in psi):

TABLE 1

| Tensile strength | A2 | A3 | B | F | G |
|---|---|---|---|---|---|
| 1 hr (psi) | 215.6 | 227.6 | 213.6 | 170.1 | 66.2 |
| 1 hr StDev | 9.2 | 5.5 | 15.5 | 17.3 | 1.3 |
| 3 hr (psi) | 241.2 | 280.8 | 234.8 | 189.2 | 77.9 |
| 3 hr StDev | 17.6 | 18.0 | 5.0 | 4.8 | 5.1 |
| 24 hr (psi) | 304.0 | 294.7 | 259.3 | 186.7 | 78.2 |
| 24 hr StDev | 26.7 | 13.1 | 11.0 | 16.2 | 7.3 |
| 24 hr-90% RH (psi) | 101.7 | 99.3 | 99.3 | 75.0 | 39.0 |
| Adding the 24 hr-90% RH StDev | 1.5 | 20 | 2.5 | 5.2 | 2.6 |

The above data show that halloysite clay can provide an effective smoke-reducing additive to a polyurethane-forming binder system at a level of 2% by weight BOS while retaining a commercially acceptable level of tensile strength, work time and strip time. At 4% by weight BOS, the halloysite clay provides remarkable smoke-reduction, but the working properties of the foundry mix are significantly compromised, probably to an unacceptably low level. Further work is justified in the space between 2% and 4%, to optimize the smoke-reduction with regard to the working properties of tensile strength, work time and strip time.

What is claimed is:

1. A foundry mix composition, comprising:

a polyurethane binder precursor, provided in two parts, the first part comprising a polyol component and the second part comprising a polyisocyanate component;

a liquid curing catalyst;

a foundry aggregate; and a halloysite clay, present in the range of from about 1 to about 4 wt %, based on the weight of the foundry aggregate.

2. The foundry mix composition of claim 1, wherein:

the liquid curing catalyst is a liquid amine catalyst, containing 4-(3-phenylpropyl) pyridine with solvent naphtha.

3. The foundry mix composition of claim 2, wherein:

the liquid curing catalyst is present at about 4 wt %, based on the first part of the polyurethane binder precursor.

4. The foundry mix composition of claim 1, wherein:

the polyol component comprises a phenolic resole resin with dibasic esters and solvent naphtha.

5. The foundry mix composition of claim 4, wherein:

the polyisocyanate component comprises an isocyanate with rapeseed methyl ester and solvent naphtha.

6. The foundry mix composition of claim 5, wherein a weight ratio of the first part of the polyurethane binder precursor to the second part of the polyurethane binder precursor is about 60/40, exclusive of the liquid curing catalyst.

7. The foundry mix composition of claim 1, wherein:

the polyisocyanate component comprises an isocyanate with rapeseed methyl ester and solvent naphtha.

8. The foundry mix composition of claim 7, wherein a weight ratio of the first part of the polyurethane binder precursor to the second part of the polyurethane binder precursor is about 60/40, exclusive of the liquid curing catalyst.

9. The foundry mix composition of claim 1, wherein a weight ratio of the first part of the polyurethane binder precursor to the second part of the polyurethane binder precursor is about 60/40, exclusive of the liquid curing catalyst.

10. The foundry mix composition of claim 9, wherein the polyurethane binder precursor is about 1.2% by weight, based on the weight of the foundry aggregate.

11. The foundry mix composition of claim 1, wherein the polyurethane binder precursor is about 1.2% by weight, based on the weight of the foundry aggregate.

12. The foundry mix composition of claim 11, wherein:

the polyol component comprises a phenolic resole resin with dibasic esters and solvent naphtha.

13. The foundry mix composition of claim 12, wherein:

the polyisocyanate component comprises an isocyanate with rapeseed methyl ester and solvent naphtha.

14. The foundry mix composition of claim 13, wherein a weight ratio of the first part of the polyurethane binder precursor to the second part of the polyurethane binder precursor is about 60/40, exclusive of the liquid curing catalyst.

15. A method for preparing a foundry mix, comprising the steps of:

adding a halloysite clay to a foundry aggregate and mixing, wherein the halloysite clay is present in an amount in the range of about 1 to about 4 wt %, based on the weight of the foundry aggregate;

adding, to the mixed halloysite clay and foundry aggregate, a first part of a polyurethane binder precursor and a liquid curing catalyst and mixing, the first part of the polyurethane binder precursor comprising a polyol component; and adding a second part of the polyurethane binder precursor, the second part of the polyurethane binder precursor comprising a polyisocyanate component.

16. The method of claim 15, wherein a weight ratio of the first part of the polyurethane binder precursor to the second part of the polyurethane binder precursor is about 3 to 2, exclusive of the liquid curing catalyst.

17. The method of claim 16, wherein the polyurethane binder precursor is about 1.2% by weight, based on the weight of the foundry aggregate.

18. The method of claim 15, wherein the polyurethane binder precursor is about 1.2% by weight, based on the weight of the foundry aggregate.

19. A foundry mold or core, comprising the foundry mix composition according to claim 1.

20. A no bake process for preparing a foundry shape, comprising the steps of:

providing an amount of the foundry mix composition of claim 1;

mixing intimately the halloysite clay with the foundry aggregate;

preparing a foundry molding compound by separately mixing the polyurethane binder precursor and the liquid curing catalyst with the mixed halloysite clay and foundry aggregate;

inserting the foundry molding compound into a pattern, allowing the mixture to cure into a foundry shape, and removing the foundry shape from the pattern.

* * * * *